US009816042B2

(12) United States Patent
Sijben

(10) Patent No.: US 9,816,042 B2
(45) **Date of Patent: *Nov. 14, 2017**

(54) MOTOR FUEL BASED ON GASOLINE AND ETHANOL

(71) Applicant: SHE BLENDS HOLDING B.V., Breda (NL)

(72) Inventor: Johannes Maria Franciscus Sijben, Etten-Leur (NL)

(73) Assignee: SHE BLENDS HOLDING B.V., Breda (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/221,172

(22) Filed: Jul. 27, 2016

(65) Prior Publication Data

US 2016/0376514 A1 Dec. 29, 2016

Related U.S. Application Data

(63) Continuation of application No. 11/922,619, filed as application No. PCT/NL2006/000298 on Jun. 19, 2006, now Pat. No. 9,447,352.

(Continued)

(51) Int. Cl.
*C10L 1/18* (2006.01)
*C10L 1/182* (2006.01)

(Continued)

(52) U.S. Cl.
CPC ..... *C10L 1/1824* (2013.01); *C10L 1/023* (2013.01); *C10L 1/125* (2013.01); *C10L 1/328* (2013.01);

(Continued)

(58) Field of Classification Search
CPC ..... C10L 1/023; C10L 1/125; C10L 1/1824; C10L 1/328; C10L 2200/0423; C10L 2270/023

(Continued)

(56) References Cited

U.S. PATENT DOCUMENTS 4,154,580 A 5/1979 Landis
4,207,076 A 6/1980 Bove et al.

(Continued)

FOREIGN PATENT DOCUMENTS

CA 1 183 682 3/1985
CA 1183682 A1 * 3/1985

(Continued)

OTHER PUBLICATIONS

T. M. Letcher et al., "Ternary Phase Diagrams for Gasoline-Water-Alcohol Mixtures", Fuel, Jul. 1986, pp. 891-894.

(Continued)

*Primary Examiner* — Latosha Hines
(74) *Attorney, Agent, or Firm* — Preti Flaherty Beliveau & Pachios LLP

(57) ABSTRACT

Motor fuel compositions containing ethanol, also known as gasohol, are disclosed, wherein the motor fuel is substantially in one phase and contains, 1 to 50, preferable 2 to 30 weight % of ethanol and an amount of water between 1 and 10 wt. % on the basis of the weight of the ethanol. Such motor fuel compositions can be produced by blending gasoline with hydrous ethanol, thus evading the necessity to use anhydrous ethanol as feedstock. Furthermore such motor fuel compositions may be produced by blending gasoline with hydrous ethanol and anhydrous ethanol, thus evading the necessity to use anhydrous ethanol as the sole feedstock. These motor fuel compositions may contain a second liquid phase that does not form a separate layer, and where no (Continued)

separate liquid phase can be detected by vision, and so meets with the specification that has become known as "clear and bright".

4 Claims, 1 Drawing Sheet

Related U.S. Application Data

(60) Provisional application No. 60/595,284, filed on Jun. 21, 2005.

(51) Int. Cl.
*C10L 1/02* (2006.01)
*C10L 1/32* (2006.01)
*C10L 1/12* (2006.01)

(52) U.S. Cl.
CPC . *C10L 2200/0423* (2013.01); *C10L 2270/023* (2013.01)

(58) Field of Classification Search
USPC ..... 44/451
See application file for complete search history.

(56) References Cited

U.S. PATENT DOCUMENTS

| | | | |
|---|---|---|---|
| 4,207,077 | A | 6/1980 | Bove et al. |
| 4,398,921 | A | 8/1983 | Rifkin et al. |
| 4,410,333 | A | 10/1983 | Fujimoto |
| 4,490,153 | A | 12/1984 | Sze et al. |

FOREIGN PATENT DOCUMENTS

| | | |
|---|---|---|
| CA | 1 221 539 | 5/1987 |
| JP | 2002-12404 | 1/2002 |
| JP | 2005-187520 | 7/2005 |
| JP | 2005-187706 | 7/2005 |
| JP | 2005-298530 | 10/2005 |
| JP | 2006-199754 | 8/2006 |
| JP | 2006-249309 | 9/2006 |
| JP | 2006-249310 | 9/2006 |
| KR | 1985-0001274 | 9/1985 |
| WO | WO 97/18279 | 5/1997 |
| WO | WO 02/088280 | 11/2002 |
| WO | WO 2004/055134 | 7/2004 |

OTHER PUBLICATIONS

Paivi Aakko et al., "Technical View on Biofuels for Transportation Focus on Ethanol End-Use Aspects", VTT Processes Research Report May 5, 2004.

S.E. Powers et al., "Chapter 2: A Critical Review: The Effect of Ethanol in Gasoline on the Fate and Transport of BTEK in the Subsurface", Potential Ground and Surface Water Impacts, Dec. 1999.

Ian A. Furzer, "Liquid-liquid equilibria by use of using UNIFAC for gasohol extraction systems", Industrial & Engineering Chemistry Process Design and Development, 1984.

Gong, Dog-Mei et al., "Study on the Problems of Phase Separation of Ethanol Gasoline," Apr. 7, 2003 (English abstract).

Xu, Cang-su et al., "Study of Water Contended Ethanol in IC Engines," (English Abstract), Chinese Internal Combustion Engine Engineering, vol. 25 No. 4, Aug. 2004.

Xu, Cang-su et al., "An Experimental Investigation into Motorcycle Engines Fueled with Partial Ethanol," (English abstract), Neiranji Gongeheng, vol. 24 (2003) No. 5.

"Drinking Water Treatment" U.S. Encironmental Protection Agency, Safe Drinking Water Act. 1974-2004, www.epa.gov/safewatr_EPA_816-F-04-034.

Hague Quality Water, The Right Solution City vs. Well Water, http://www.haguewater,com/city-well.

MiMi Gardening, "City Water," http;//en.mimi./hu/gardening/city_water.html.

Donovan, Brian, "Anhydrous Ethanol vs. Hydrous Ethanol in Gasoline Blending," Renergie, Apr. 22, 2009, https://lieldtopump.wordpress.com/2009/04/22/anhydrous-ethanol-vs-hydrous-ethanol-in-gasoline-blending/.

R. Katzen, P.W. Madson, et al., "Ethanol Distillation: The Fundamentals" www.chmeng.queensu.ca/courses/CHEE332/files/distillation.pdf.

R. Katzen, P.W. Madson, et al., "Ethanol Distillation: The Fundamentals" www.chemeng.queensu.ca/courses/CHEE332/files/distillation.pdf.

"Drinking Water Treatment," U.S. Environmental Potection Agency, Safe Drinking Water Act, 1974-2004, www.epa.gov/safewater EPA 816-F-04-034.

"Hague Quality Water, The Right Solution," City vs. Well Water, http://www.haguewater.com/city-well.

MiMi Gardening, "City Water," http://en.mimi.hu/gardening/city_water.html.

Donovan, Brian, "Anhydrous Ethanol vs. Hydrous Ethanol in Gasoline Blending," Renergie, Apr. 22, 2009, https://fieldtopump.wordpress.com/2009/04/22/anhydrous-ethanol-vs-hydrous-ethanol-in-gasoline-blending/.

T.M. Letcher et al., "Ternary Phase Diagrams for Gasoline-Water-Alcohol Mixtures", Fuel, Jul. 1986, pp. 891-894.

Paivi Aakko et al., "Technical View on Biofuels for Transportation Focus on Ethanol End-Use Aspects", VTT Processes Research Report, May 5, 2004.

* cited by examiner

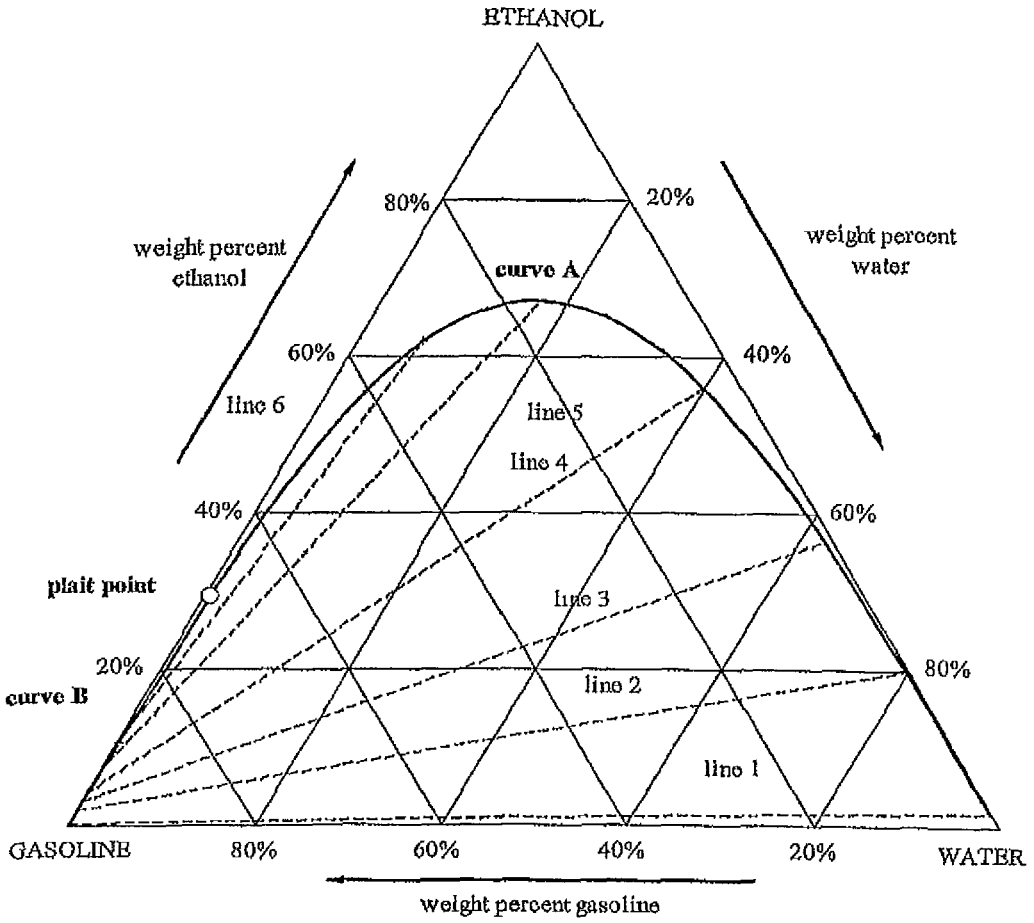
ETHANOL
80%
20%
weight percent ethanol
weight percent water
curve A
60%
40%
line 6
line 5
line 4
40%
60%
plait point
line 3
20%
80%
curve B
line 2
line 1
GASOLINE
80%
60%
40%
20%
WATER
weight percent gasoline

MOTOR FUEL BASED ON GASOLINE AND ETHANOL

This application is a continuation of U.S. application Ser. No. 11/922,619, which was deposited with the U.S. Patent and Trademark Office on Dec. 19, 2007 and received a §371(c) date of Mar. 4, 2008, and which is a §371 national phase filing of PCT/NL2006/000298 filed on Jun. 19, 2006, and claims priority to U.S. Provisional Patent Application No. 60/595,284 filed on Jun. 21, 2005.

This invention relates to motor fuel compositions and in particular to compositions of motor fuel blende of gasoline and anhydrous ethanol and hydrous ethanol without additives or other measures to prevent the occurrence of a separate liquid phase.

This invention allows the use of hydrous ethanol as part of the feedstock or as the only feedstock for producing gasoline-ethanol fuels, also known as gasohol, that meet the specification "clear and bright". The production of hydrous ethanol requires less energy than production of anhydrous ethanol. Furthermore the production of hydrous ethanol is considerably cheaper than the production of anhydrous ethanol.

BACKGROUND OF THE INVENTION

It is widely known that gasoline and water do not mix. This means that water, when added to gasoline, forms a separate liquid phase which contains virtually all the water and a very small amount of gasoline, and is generally termed the "water phase". The other phase, the "gasoline phase" contains a very small amount of water. The water phase has physical properties that are totally different from the gasoline phase. The density of the water phase at ambient conditions is typically 1000 kg/m3 whereas the density of the gasoline phase is typically 700 kg/m3. The interfacial tension between the water phase and the gasoline phase is typically 0.055 N/m. This means that droplets of the water phase in the gasoline phase have a strong tendency to coalesce. Furthermore, the density difference leads to a rapid disengagement of the two liquid phase into a lower water layer and an upper gasoline layer. The presence of a separate water layer is generally known to be harmful to systems for fuel storage and distribution, car fuel tanks, fuel injection systems and related systems.

Gasoline and anhydrous ethanol are miscible in any ratio, i.e. they can be mixed without occurrence of a separate liquid phase. When a certain amount of water is present, however, a separate liquid layer will occur. The maximum amount of water that does not cause a separate liquid layer to appear shall be known here as the "water tolerance". The occurrence of a separate liquid phase in gasohol is perceived as harmful even though the phase behavior of gasoline-ethanol-water mixtures is totally different from gasoline-water mixtures. There are several inventions on the subject of preventing the occurrence of a separate liquid phase, also known as "stabilizing". U.S. Pat. No. 4,154,580 describes a method for producing stabilized gasoline-alcohol fuels by chemically hydrating the olefinic gasoline constituents to alcohols, which increases the water tolerance. U.S. Pat. Nos. 4,207,076 and 4,207,077 describe a method to increase the water tolerance of gasohol fuels by adding ethyl-t-butyl ether or methyl-t-butyl ether, respectively. U.S. Pat. No. 4,490,158 describes a manufacturing procedure for gasohol fuels using liquid-liquid extraction operated at −10° F. (−23.3° C.). Gasohol produced at these low temperatures are stable at all temperatures above −10° C.

All methods, such as the ones described in the aforementioned patents, employ major operating facilities, such as reactors, distillation columns, extraction columns and vessels and heat exchangers. Also they use substantial amounts of energy such as steam and electricity and skilled personnel is required to start-up, control, maintain and shut-down such processing facilities. Furthermore said operating facilities produce waste materials such as a wastewater that contains ethanol and gasoline, and that must be sent to wastewater treatment facilities or waste incineration facilities, before disposal into the environment. The necessity of said facilities restricts the manufacture of gasohol to areas where such facilities are present, for example a refinery. In many regions, however, it is preferred to manufacture gasohol by simple blending at a fuel distribution terminal or other sites where said processing facilities are not present.

The perceived harmfulness of a separate liquid phase drives gasohol manufacturing companies to the use anhydrous ethanol.

BRIEF DESCRIPTION OF THE DRAWINGS

FIG. 1 shows a liquid-liquid phase diagram of the system water (1)-ethanol (2)-gasoline (3) at 20° C. In this graph the concentrations of all gasoline components are compounded and represented as a single substance.

DETAILED DESCRIPTION OF THE INVENTION

The object of this invention is to provide gasoline-ethanol blends, also known as "gasohol" fuel for internal combustion engines, without the disadvantages discussed above, and preferably using hydrous ethanol as feedstock.

Also it is an object to use the present invention at a fuel distribution terminal, or more generally at a location where no major processing facilities are present.

Furthermore it is an object of this invention to provide a gasoline-ethanol blend without the need for additives or other measures to prevent the formation of a separate liquid phase.

In the broadest sense, the invention is based thereon, that within very narrow compositional ranges, a motor fuel composition containing water and ethanol can be obtained, substantially without phase separation.

The invention is defined as a motor fuel based on gasoline and ethanol, containing water, wherein the motor fuel is substantially in one phase and contains 2 to 50, preferably 30 weight % of ethanol and an amount of water between 1 and 10 wt. % on the basis of the weight of the ethanol.

In a preferred embodiment the motor fuel contains 0.02 to 3 weight %, preferably 0.05 to 8 wt. % of water.

The advantages and features of the invention will become more readily apparent when viewed in light of FIG. 1.

FIG. 1 shows a ternary liquid-liquid phase diagram. Although gasoline is a multi-component mixture, the weight percentages of all gasoline constituents have been compounded and thus the water-ethanol-gasoline mixture can be considered as a ternary mixture, i.e. a mixture of three components. The curves and lines in this diagram represent compositions that have been calculated by a computer program, employing a suitable method for the estimation of phase equilibrium compositions. All data in the diagram refer to phase equilibria at 20° C. For constructing the phase diagram in FIG. 1 we have assumed a certain gasoline composition.

In the ternary diagram two curves are drawn, termed "curve A" and "curve B". Curve A runs from the gasoline angle of the ternary diagram to the point denoted as "plait point". Curve B runs from the water angle of the ternary diagram to the plait point. The area in the phase diagram below "curve A" and "curve B" is the two-liquid region. A mixture composition that falls in that region produces two liquid phases. The composition of the coexisting liquid phases are represented by the vertices of so-called "tie-lines". Six examples of such tie-lines are shown in FIG. 1 and marked "line 1" to "line 6". In the context of the present invention we will denominate compositions on curve A as representing the "second liquid phase", and compositions on curve B as representing the "gasoline phase". The amount of each of the two liquid phases can be determined from the tie-lines by the lever rule, which is known to one acquainted with phase diagrams. The point marked as "plait point" represents the composition where the length of the tie-line is zero. It should be noted that the composition of the gasoline fraction in the coexisting liquid phases will be different to some extent. The exact location of curves A and B and the slopes of the tie-lines depend on the composition of the gasoline. We assumed a certain gasoline composition for making the phase equilibrium calculations, that form the basis of FIG. 1. With this composition, the location of the plait point is as follows: 29.5 weight percent ethanol, 0.6 weight percent of water and 69.9 weight percent gasoline.

From the phase diagram it can be learned that ethanol has a strong tendency to stay in the second liquid phase. At low ethanol concentrations, which are represented by the region near the gasoline-water side of the phase diagram, practically all compositions fall in the two-liquid region, and the second liquid phase is rich in water and consequently is characterized as "water phase". In this region the physical properties of the coexisting phases are very different and they will readily disengage in a lower water phase and an upper gasoline phase. At low water concentrations, which are represented by the region near the gasoline-ethanol side of the phase diagram, the phase behavior strongly depends on the ethanol concentration. Near the plait point the composition of the two liquid phases will be rather similar and as a result the physical properties of these phases will be similar. Moving from the plait point into the direction of the water angle of the ternary diagram, the further away from the plait point, the greater will be the difference between the physical properties of the coexisting liquid phases.

Similarity in composition and physical properties will prevent a two-liquid phase system from becoming a visibly inhomogeneous mixture. Said similarity in composition and physical properties makes the system suitable for fuel with specification "clear and bright".

The phrase "anhydrous ethanol" refers to ethanol free of water. In 26 industrial practice there is specification for the maximum water content of anhydrous ethanol, which is typically 0.1-0.8 percent weight, "Dehydrated alcohol" is synonym for anhydrous alcohol.

The phrase "hydrous ethanol" refers to a mixture of ethanol and water. In industrial practice, hydrous ethanol typically contains 4-5 percent weight of water. "Hydrated ethanol" is synonym for hydrous ethanol.

The phrase "gasoline" refers to a mixture of hydrocarbons boiling in the approximate range of 40° C. to 200° C. and that can be used as fuel for internal combustion engines. Gasoline may contain substances of various nature, which are added in relatively small amounts, to serve a particular purpose, such as MTBE or ETBE to increase the octane number.

The phrase "gasohol" refers to a mixture of gasoline and ethanol. Generally the ethanol content is between 1 and 20 weight %. Typically the ethanol content is 10 weight % or more.

The phrase "water tolerance" refers to the maximum concentration of water in a gasoline-ethanol mixture that does not cause a separate liquid phase to appear. The water tolerance can be expressed as fraction of the ethanol present in the mixture.

The fuel of the present invention can be produced in various ways, the preferred way being the simple blending of the gasoline with the hydrous ethanol. Other possibilities are the blending of the separate components, gasoline, ethanol and water or of other combinations, such as wet gasoline with ethanol, to produce the required composition.

The present invention, thus generally described, will be understood more readily by reference to the following examples, which are provided by way of illustration and should not be construed as limiting any aspect of the present invention. The data in the examples have all been calculated by a computer program, employing a suitable method for the estimation of phase equilibrium compositions and physical properties. The gasoline that we have considered for these calculations has the following composition: 18 weight percent of normal paraffins, 55 weight percent of iso paraffins, 1 weight percent of olefins and 25 percent weight of aromatics.

EXAMPLE 1

This example relates to a mixture of 850 kg gasoline and 150 kg hydrous ethanol. The hydrous ethanol contains 5 weight percent of water. The calculations have been performed for two temperatures, namely 20 degrees Celsius and 0 degrees Celsius. As a result of the mixing process two liquid phases coexist. The composition of these phases and some of their physical properties are shown in Table I.

TABLE 1

| | | temperature | |
|---|---|---|---|
| | unit of measure | 0° C. | 20° C. |
| second liquid phase | | | |
| fraction of total | weight percent | 9% | 7% |
| water content | weight percent | 6.2% | 7.5% |
| ethanol content | weight percent | 60.9% | 61.6% |
| gasoline content | weight percent | 32.9% | 30.9% |
| density | kg/m3 | 799 | 782 |
| viscosity | Ns/m2 | 1.24E−03 | 8.72E−04 |
| surface tension | N/m | 0.041 | 0.041 |
| gasoline phase | weight percent | | |
| fraction of total | weight percent | 91% | 93% |
| water content | weight percent | 0.1% | 0.2% |
| ethanol content | weight percent | 9.0% | 10.5% |
| gasoline content | weight percent | 90.8% | 89.3% |
| density | kg/m3 | 726 | 710 |
| viscosity | Ns/m2 | 5.58E−04 | 4.43E−04 |
| surface tension | N/m | 0.024 | 0.023 |
| density difference | kg/m3 | 73 | 72 |
| interfacial tension | N/m | 0.017 | 0.018 |

From Table 1 it can be concluded that the interfacial tension between the two coexisting liquid phases is small, which means that little work is required to create an interfacial surface. Furthermore, the density difference between the two liquid phases is small, which means that there is little or no tendency of the second liquid phase to collect as a separate liquid layer. The small density difference, small interfacial tension and similar refractive indices of the two phases, loads to an apparently homogeneous liquid mixture where no phase boundary can be detected by vision, and thus will meet the specification "clear and bright".

EXAMPLE 2

This example relates to a mixture of 850 kg gasoline and 150 kg hydrous ethanol. The hydrous ethanol contains 1.5 weight percent of water. The calculations have been performed for two temperatures, namely 20 degrees Celsius and 0 degrees Celsius. At 20 degrees Celsius the mixture is homogeneous, at 0 degrees Celsius two liquid phases coexist. The composition of these phases and some of their physical properties are shown in Table 2.

TABLE 2

| | | temperature | |
|---|---|---|---|
| | unit of measure | 0° C. | 20° C. |
| second liquid phase | | | |
| fraction of total | weight percent | 1.3% | |
| water content | weight percent | 2.1% | |
| ethanol content | weight percent | 48.4% | |
| gasoline content | weight percent | 49.5% | |
| density | kg/m3 | 774 | |
| viscosity | Ns/m2 | 1.07E−03 | |
| surface tension | N/m | 0.035 | |
| gasoline phase | weight percent | | |
| fraction of total | weight percent | 98.7% | 100.0% |
| water content | weight percent | 0.2% | 0.2% |
| ethanol content | weight percent | 14.3% | 14.8% |
| gasoline content | weight percent | 85.5% | 85.0% |
| density | kg/m3 | 733 | 715 |
| viscosity | Ns/m2 | 6.24E−04 | 4.78E−04 |
| surface tension | N/m | 0.026 | 0.024 |
| density difference | kg/m3 | 41 | |
| interfacial tension | N/m | 0.009 | |

From Table 2 can be concluded that hydrous ethanol containing 1.5 percent weight of water can be mixed with gasoline to produce a gasohol with 15 weight percent of ethanol, that does not form a second liquid phase at ambient conditions. At 0 degrees Celsius this mixture forms a small amount of second liquid phase of approximately equal weight of gasoline and ethanol and approximately 2 weight percent of water. The presence of this small amount of a second liquid phase with similar physical properties will not be detectable by vision and thus will meet the specification clear and bright.

The invention claimed is:

1. A motor fuel comprising:

a gasoline component; and a hydrous ethanol component consisting of a distilled mixture of ethanol and water;

wherein the motor fuel comprises an ethanol amount of 1 to 50 weight % and a water amount of between 1.5 and 6 weight % on the basis of a weight of the ethanol amount; and wherein the motor fuel is substantially in one phase and does not have a separate liquid layer at ambient temperature and thereby meets a clear and bright motor fuel specification; and wherein the motor fuel does not contain additives to prevent the occurrence of the separate liquid layer and harmful effects thereof.

2. An engine comprising:

an engine being an internal combustion engine; and a motor fuel for powering the internal combustion engine, the motor fuel comprising:

a gasoline component; and a hydrous ethanol component consisting of a distilled mixture of ethanol and water;

wherein the motor fuel comprises an ethanol amount of 1 to 50 weight % and a water amount of between 1.5 and 10 weight % on the basis of a weight of the ethanol amount; and wherein the motor fuel is substantially in one phase and does not have a separate liquid layer at ambient temperature and thereby meets a clear and bright motor fuel specification.

3. The engine of claim 2, wherein the motor fuel does not contain additives to prevent the occurrence of the separate liquid layer and harmful effects thereof.

4. The engine of claim 2, wherein the motor fuel comprises a water amount of between 1.5 and 6 weight % on the basis of a weight of the ethanol amount.

* * * * *